US010309062B2

(12) United States Patent
Halvardsson et al.

(10) Patent No.: US 10,309,062 B2
(45) Date of Patent: Jun. 4, 2019

(54) METHOD AND DEVICE FOR MANUFACTURING A FIBRE MOULDING AND A FIBRE MOULDING MANUFACTURED USING THESE

(71) Applicant: SIG Technology AG, Neuhausen am Rheinfall (CH)

(72) Inventors: Christer Halvardsson, Sunne (SE); David Kjellin, Karlstad (SE)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 15/515,400

(22) PCT Filed: Sep. 29, 2015

(86) PCT No.: PCT/EP2015/072367
§ 371 (c)(1),
(2) Date: Mar. 29, 2017

(87) PCT Pub. No.: WO2016/050737
PCT Pub. Date: Apr. 7, 2016

(65) Prior Publication Data

US 2017/0226699 A1 Aug. 10, 2017

(30) Foreign Application Priority Data

Sep. 30, 2014 (DE) ..... 10 2014 114 187

(51) Int. Cl.
*D21J 5/00* (2006.01)
*D21J 7/00* (2006.01)

(52) U.S. Cl.
CPC .. *D21J 5/00* (2013.01); *D21J 7/00* (2013.01)

(58) Field of Classification Search
CPC ..... D21J 3/10; D21J 7/00; D21J 3/00; D21J 5/00; D21J 1/08; D21J 3/12; B29L 2031/712; B29L 2031/565
See application file for complete search history.

(56) References Cited

U.S. PATENT DOCUMENTS 1,623,111 A * 4/1927 Hall ..... D21J 3/00 162/402
2,159,638 A * 5/1939 Schur ..... D21J 3/00 162/135

(Continued)

FOREIGN PATENT DOCUMENTS

CN 1707024 A 12/2005
CN 102268849 A 12/2011

(Continued)

*Primary Examiner* — Jose A Fortuna
(74) *Attorney, Agent, or Firm* — The Webb Law Firm

(57) ABSTRACT

A method and a device for manufacturing a fiber molding for drinks packaging containers having an improved structure and surface quality. The method includes the following steps: dipping of a forming wire arranged on a toolholder into a pulp slurry, lifting of the toolholder in order to move the covered forming wire completely out of the pulp slurry, compressing of the fiber material in an area of the circumferential edge of the forming wire through inflating of a circumferential collar, relaxing of the pressure in the collar, and removing of the fiber molding. A device for manufacturing of a fiber molding is also provided.

10 Claims, 4 Drawing Sheets

(56) References Cited

U.S. PATENT DOCUMENTS

| | | | | |
|---|---|---|---|---|
| 2,377,864 | A | 6/1945 | Chaplin | |
| 3,216,890 | A | 11/1965 | Crabtree | |
| 3,250,668 | A | 5/1966 | Modersohn | |
| 3,596,314 | A * | 8/1971 | Krugler | D21J 3/00 425/388 |
| 3,793,138 | A * | 2/1974 | Rohrer | D21J 7/00 162/219 |
| 4,527,699 | A | 7/1985 | Namba et al. | |
| 5,039,465 | A * | 8/1991 | Freeman | B29B 11/16 162/116 |
| 5,356,518 | A | 10/1994 | Kelley et al. | |
| 6,461,480 | B1 * | 10/2002 | Otakura | D21J 3/10 162/220 |
| 7,008,509 | B1 * | 3/2006 | Otani | D21J 3/10 162/218 |
| 7,048,975 | B1 * | 5/2006 | Tojo | B65D 1/0207 428/213 |
| 7,708,863 | B2 * | 5/2010 | Petroski | D21J 3/00 162/218 |
| 9,663,898 | B2 * | 5/2017 | Zhang | D21J 3/00 |
| 9,765,484 | B2 * | 9/2017 | Wang | D21J 7/00 |
| 9,856,608 | B1 * | 1/2018 | Chung | B05D 1/02 |
| 9,869,062 | B1 * | 1/2018 | Chung | B65D 65/466 |
| 9,951,478 | B2 * | 4/2018 | Kuo | D21J 3/00 |
| 9,976,262 | B2 * | 5/2018 | Kuo | D21J 3/00 |
| 2001/0040016 | A1 * | 11/2001 | Kumamoto | B65D 1/0207 162/218 |
| 2004/0041305 | A1 * | 3/2004 | Tsuura | D21J 3/10 264/335 |
| 2004/0045690 | A1 * | 3/2004 | Eto | D21J 3/10 162/225 |
| 2004/0241274 | A1 | 12/2004 | Odajima et al. | |
| 2010/0294448 | A1 * | 11/2010 | Pierce | D21J 3/10 162/224 |
| 2011/0036846 | A1 * | 2/2011 | Corbett | B65D 77/06 220/495.03 |
| 2011/0139660 | A1 * | 6/2011 | Cabell | B29C 51/162 206/459.5 |
| 2011/0174676 | A1 * | 7/2011 | Stockhaus | B32B 7/06 206/557 |
| 2012/0132361 | A1 * | 5/2012 | Corbett | D21J 3/10 156/287 |
| 2012/0248117 | A1 * | 10/2012 | Corbett | B65D 23/102 220/495.06 |
| 2013/0193138 | A1 | 8/2013 | Alther et al. | |
| 2015/0308050 | A1 * | 10/2015 | Corbett | B29C 49/0047 162/218 |
| 2016/0145811 | A1 * | 5/2016 | Socci | D21J 3/10 162/217 |
| 2017/0225384 | A1 * | 8/2017 | Halvardsson | B29C 51/162 |
| 2017/0226699 | A1 * | 8/2017 | Halvardsson | D21J 7/00 |

FOREIGN PATENT DOCUMENTS

| | | | | |
|---|---|---|---|---|
| CN | 203583290 | U | 5/2014 | |
| DE | 102010014993 | A1 | 3/2015 | |
| DE | 102014014993 | A1 | 4/2016 | |
| EP | 0893355 | A2 | 1/1999 | |
| EP | 1439264 | A1 | 7/2004 | |
| GB | 469882 | A | 8/1937 | |
| JP | 2003041499 | A * | 2/2003 | D21J 3/10 |
| WO | WO-2010030958 | A2 * | 3/2010 | B65D 77/06 |
| WO | WO-2011112712 | A1 * | 9/2011 | B65D 77/06 |
| WO | WO-2013036695 | A1 * | 3/2013 | B65D 25/18 |
| WO | WO-2016081614 | A1 * | 5/2016 | D21J 3/10 |

* cited by examiner

METHOD AND DEVICE FOR MANUFACTURING A FIBRE MOULDING AND A FIBRE MOULDING MANUFACTURED USING THESE

CROSS-REFERENCE TO RELATED APPLICATIONS

This application is the United States national phase of International Application No. PCT/EP2015/072367 filed Sep. 29, 2015, and claims priority to German Patent Application No. 10 2014 114 187.3 filed Sep. 30, 2014, the disclosures of which are hereby incorporated in their entirety by reference.

BACKGROUND OF THE INVENTION

Field of the Invention

The invention relates to a method and a device for manufacturing a fibre moulding, in particular a head element or base element for drinks packaging containers, and a fibre moulding manufactured using these.

Description of Related Art

Folded drinks containers made from fibre composites have long been known about, in a variety of different embodiments. The most common here are those containers manufactured from a single blank from a cardboard/plastic composite. However, multi-part containers are also known in which the head element and/or base element is/are inserted into a tube-shaped packaging sleeve and joined to the latter, or in which, initially, a container open at one end is produced by means of appropriate folding of an end and into which a lid element is then inserted, as is known for example from U.S. Pat. No. 4,527,699 or from EP 0 893 355 A2, in which inserted head elements and base elements made from plastic are used.

Moreover, manufacturing multi-part packaging containers in which a separately manufactured head element and/or base element is/are used, whereby the parts inserted are manufactured as fibre mouldings from pulp, that is to say from a fibrous slurry of cellulose, is also known about. For example, DE 10 2010 014 993 A1, which the applicant of the present patent application refers back to, describes a container and a method for manufacturing a container in which a tube-shaped base body is equipped with at least one fibre moulding connected to the base body in order to form a liquid-tight drinks container. The fibre moulding is coated so as to be gas-tight and liquid-tight, so that a container manufactured in this way can also serve as an aseptic packaging container as is required for certain foods or drinks.

Fibre mouldings and their manufacturing facilities/methods have long been known from various types of applications. Thus, by way of example, European patent application EP 1 439 264 A1 proposes a special coated drinking cup. In order to achieve different thicknesses in the material cross-section of the fibre material, the precipitated fibres are pressurised across the entire inner geometry of the cup by means of an expandable press unit and a vacuum applied on the opposite side in order to dry the fibre material.

Furthermore, tools and methods for drinking cups with geometries that are more difficult to produce (in this case with a handle) were proposed in US 2004/0241274 A1, for example. In order to enable a uniform strength and good rigidity of the fibre moulding, a special tool is provided which consists of a first solid elastic press unit and a second press unit which can be expanded by a fluid. The press units operate at the same time in order to mould, dewater and thus dry the fibre moulding. The second expandable press unit enables a pressure in the area of the undercut geometry of the handle.

Both the latter documents have the common characteristic that all compression and drying steps are simultaneously performed in the same tool. The expandable units are used to overcome special geometries.

However, known methods regularly fail in the case of coated fibre mouldings for the above-mentioned application for two-piece or multi-piece packages. It is clear that the join between the fibre moulding and the tube-shaped base body constitutes a particularly sensitive area since in this case, unlike with the folded container from a single blank, an additional seam is present which has to be made gas- and liquid-tight.

Particular requirements, therefore, are placed on the shape, structure and surface of the fibre moulding. In addition to a precise design of the surface in the (subsequent) seam area, that is to say in the area of the circumferential edge of the fibre moulding, the fibre moulding should have a smooth surface in order to be able to be coated more easily, i.e. no individual fibres should protrude from the fibre moulding. Moreover, the seam area must be so stable and compact that it can be easily connected to the tube-shaped end of a carton sleeve or a packaging that is open on one side. The joining here is generally performed by means of thermal sealing using mechanical pressure.

In order that, now, the circumferential edge of the fibre moulding has sufficient stability, U.S. Pat. No. 2,377,864 describes performing mechanical shaping and/or compaction of the peripheral area of the fibre moulding using a special, rigid moulding tool. By way of an improvement to this technical solution, U.S. Pat. No. 3,216,890 proposes carrying out the compaction of the peripheral area of a fibre moulding using a passively deformable element which compresses and hence improves the adjacent structure. Both of the named solutions are associated with a not inconsiderable design effort.

SUMMARY OF THE INVENTION

An object underlying the invention, therefore, is to propose a method and a device for manufacturing a fibre moulding in which the previously named disadvantages are avoided. A fibre moulding with an improved structure and surface quality should be produced in which no protruding fibres occur and any kind of rounded shapes can be created.

In respect of the method according to the invention, achieving this object includes the following steps:

- dipping of a forming wire arranged on a toolholder into a pulp slurry,
- lifting of the toolholder in order to move the covered forming wire out of the pulp slurry completely,
- compressing of the fibre material in the area of the circumferential edge of the forming wire by inflating a circumferential collar,
- relaxing of the pressure in the collar and
- removing of the fibre moulding.

In terms of the device, the object is achieved by a circumferential collar being provided which runs below the edge of the forming wire and can be inflated from a basic position into a working position.

Finally, the invention comprises a fibre moulding which is manufactured using the method according to the invention.

When manufacturing fibre mouldings by dipping into a pulp slurry, the forming wire used is wetted relatively uniformly, so that the moulding thus produced essentially has consistently equal thicknesses.

The invention has now recognised that a fibre moulding of any geometry can be manufactured particularly advantageously through the circumferential area on the terminal edge of the fibre moulding being capable of being equipped with a particularly compact and stable fibre layer, if, for this purpose, immediately after covering the forming wire, the fibre material in the area of the circumferential edge of the forming wire is compressed through inflating of an outer collar in the area in which the subsequent sealing with the remaining part of the drinks container takes place. According to the invention, no additional tools are required and the design effort is kept at a reasonable level through the provision of an inflatable collar together with air supply line(s).

A further teaching of the invention envisages that the upper edge of the fibre moulding is sprayed with water before being removed from the forming wire. In this way, the precipitated fibres are distributed evenly.

Alternatively, or in addition, it is possible according to a further embodiment of the invention for the fibre moulding, after removal, to be placed on a pressing tool with a corresponding geometry adapted to the fibre moulding and compacted there mechanically with a press plunger that can be lowered onto the mandrel. In this way, the outer surface of the fibre moulding and its inner structure can be improved further, since the fibre moulding still possesses residual moisture and consequently, at this stage, is further deformable or compactable.

According to a further teaching of the invention it is envisaged that the forming wire can have air applied to it from the inside in such a way that both an underpressure, for precipitation of the outer fibres, and an overpressure, for releasing and removing the fibre moulding, can be applied. In this way, the fibres precipitate faster and more evenly and can be detached very easily from the wire surface and additionally be removed pneumatically from the tool or forming wire.

Another embodiment of the invention envisages that the fibre moulding is dried after removal. Such a drying can take place in a known way using compressed air and/or by supplying thermal energy.

A further teaching of the invention envisages that the inner and, as the case may be, also the outer surface of the fibre moulding is coated so as to be gas- and/or liquid-tight. A gas- and/or liquid-tight coating is always necessary when the drinks packages equipped with such a fibre moulding are to be filled with liquid products.

According to a further embodiment of the invention, the circumferential edge of the fibre moulding and, as the case may be, an opening located in the fibre moulding, are cut to length or introduced respectively, whereby the cutting (to length) or introduction (of the opening) may take place by means of cutting, die-cutting or by means of a laser. Thus the exact fits needed can be achieved cleanly and by simple means.

The toolholder with the forming wire and the collar can be cleaned easily by being sprayed with water.

A further teaching of the invention in respect of the device used envisages that, in the interior of the forming wire, a moulding tool is arranged which corresponds to the shape of the fibre moulding and has a plurality of air channels. The air channels preferably run from at least one central supply line to different points on the outer surface of the moulding tool.

A particularly elegant design can be achieved by the collar being clamped in an inward direction by the forming wire or the moulding tool and clamped in an outward direction pressure-tightly on the toolholder by a retaining plate. In this way, optimum sealing can be achieved and the exchange of a collar that needs replacing also be effected with minimum technical effort.

In a further embodiment of the invention, it is envisaged that, below the collar, a circumferential air channel is provided which has at least one connection line for supplying and removing compressed air. In this way, it is ensured that an even inflating of the collar takes place in order to achieve an equally even compression of the lower edge of the fibre moulding.

Another teaching of the invention envisages that the mesh size of the wire mesh for the forming wire is between 40 and 62 mesh, preferably 49 mesh. Thus, with the fibres used, good surface qualities with sufficient dehydration can be achieved.

According to a further embodiment of the invention it is envisaged that the forming wire is designed as a positive mould and the collar is arranged on the lower edge of the forming wire.

Alternatively, however, it is also possible for the forming wire to be designed as a negative mould and for the collar to be arranged on the upper edge of the forming wire.

Finally, it is particularly advantageous if the collar is manufactured from a fluoroelastomer in order to give the collar a long service life.

BRIEF DESCRIPTION OF THE DRAWINGS

The invention is described in more detail below using a drawing that depicts only one preferred embodiment.

In the drawing, the following are shown.

DESCRIPTION OF THE INVENTION

Figure 1:
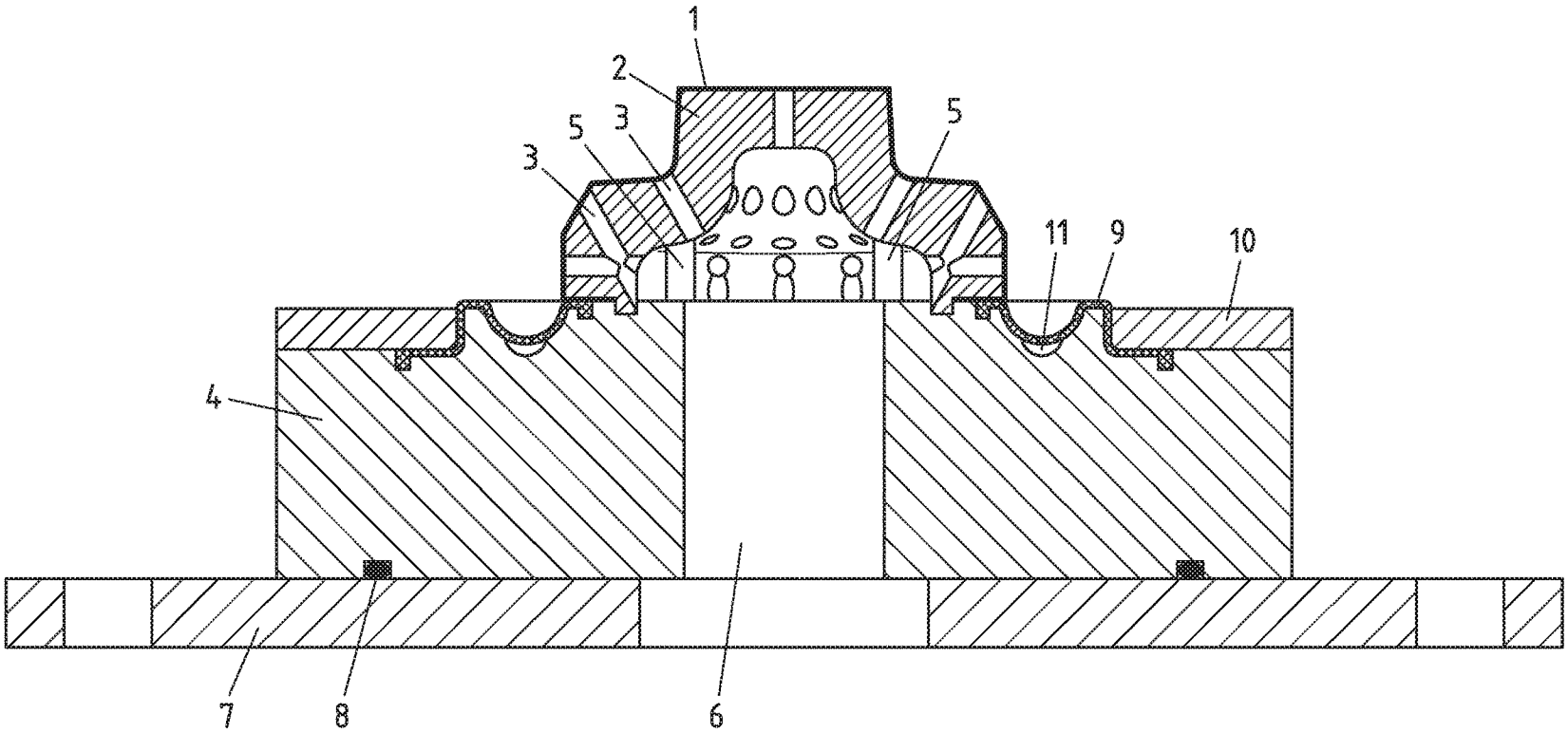
FIG. 1 a first vertical section through a device according to the invention

In FIG. 1 one first discerns a forming wire 1, which extends along the outer contour of a moulding tool 2. The moulding tool 2 is hollow on the inside and has a plurality of channels 3 which in the depicted, and in that respect preferred, embodiment, are designed as drill holes, which extend from the surface of the moulding tool 2 at suitable points up unto the hollow interior of the moulding tool 2. The moulding tool 2 is located on a toolholder 4 and is connected to this from below with screws 5 that can only partially be discerned. Toolholder 4 also has a central supply line 6 which can likewise be designed as a drill hole.

Below the toolholder 4 one discerns a fixing plate 7 which, in turn, has a central supply line for the air supply for moulding tool 2. A seal 8 that is preferably designed as an O ring provides the necessary imperviousness of the contact area between toolholder 4 and fixing plate 7. Around the moulding tool 2 is an inflatable collar 9 which, at its inner end, is clamped by moulding tool 2 with the toolholder 4 and whose outer end is clamped by a retaining plate 10 placed on top. Below the collar 9 there runs a circumferential air channel 11 which corresponds to the shape of collar 9; this is described in more detail further on.

Figure 2:
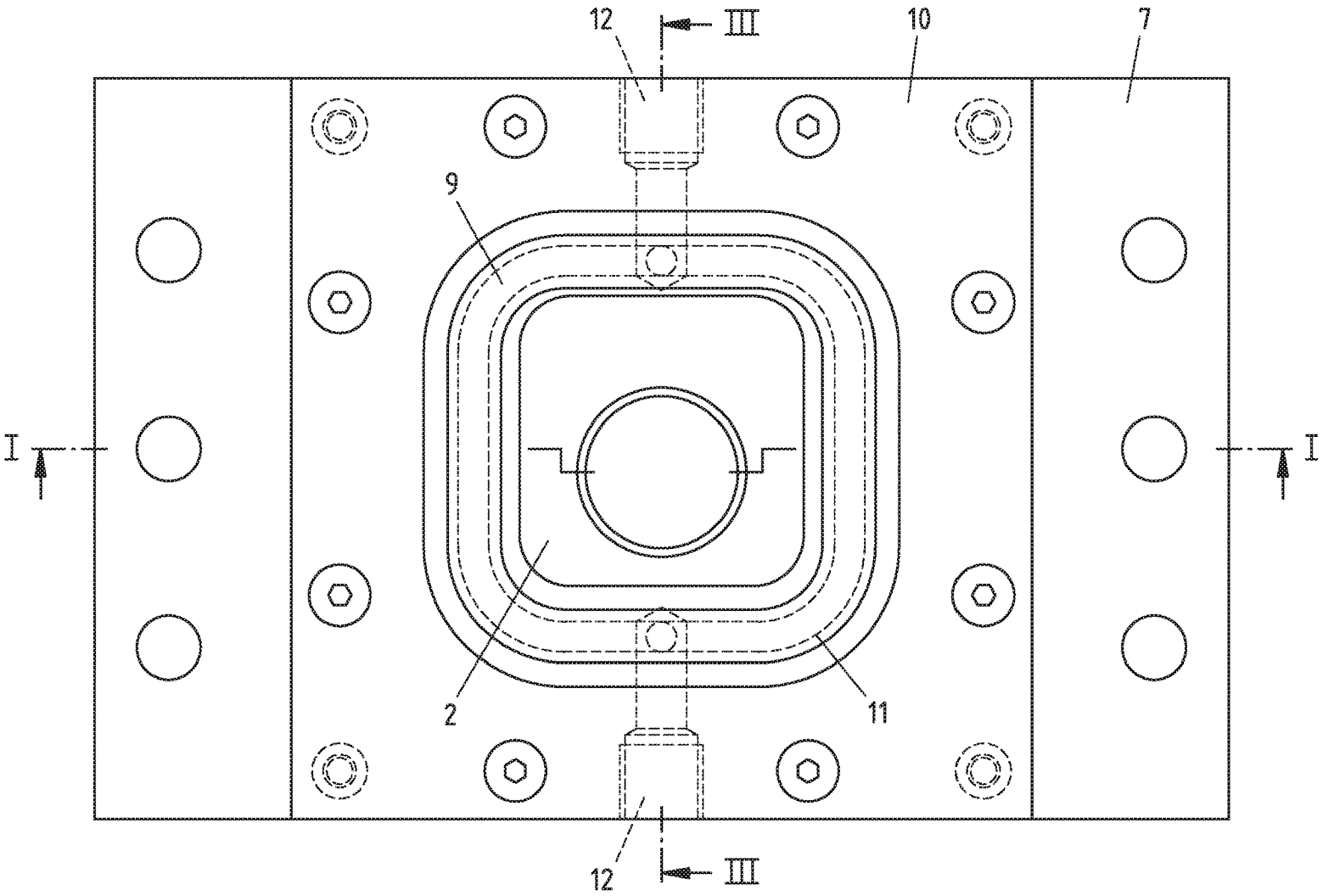
FIG. 2 a plan view of the subject matter of FIG. 1

FIG. 2, which shows a plan view of the device according to FIG. 1, clearly shows that the moulding tool 2 is designed asymmetrically and that the rising connector is arranged eccentrically to the vertical axis of the fibre moulding.

Figure 3:
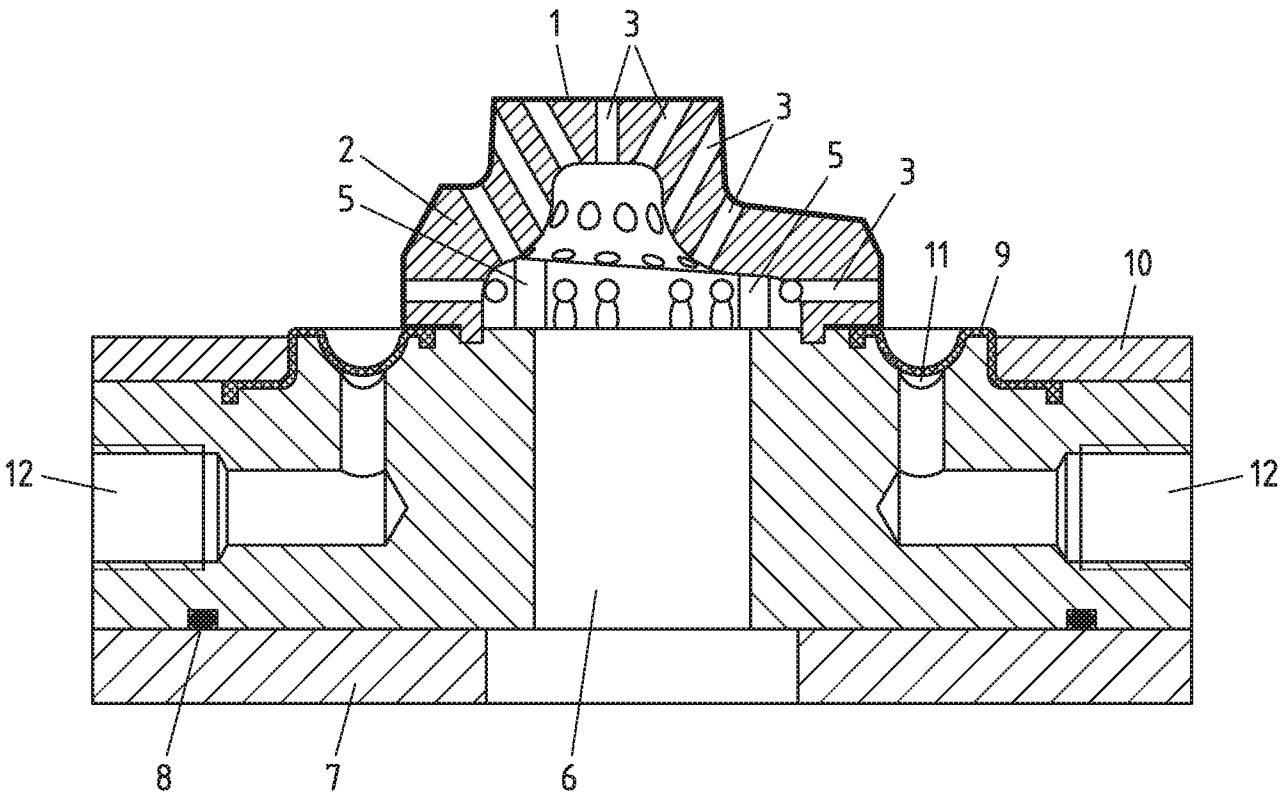
FIG. 3 a further vertical section through the device according to the invention along the line III-III from FIG. 2 and FIG. 4 a fibre moulding manufactured using the above-mentioned device, from below and in perspective view.

FIG. 3 essentially has the same structure as FIG. 1; here, however, the supply channels positioned below the circumferential ring channel 11 for a compressed air connection 12, present in duplicate in the depicted and preferred embodiment, are clearly depicted.

For manufacturing purposes, the whole device is dipped into a pulp slurry, so that the entire forming wire 1 is surrounded by pulp. After lifting the toolholder 4, the forming wire 1 is evenly covered and the fibre moulding detaches itself from the wire structure through the generation of pressure in the interior of the forming wire 1 through the drilled hole 6 and the channels 3. At the same time or directly afterwards, the circumferential collar 9 is inflated through an appropriate supply of compressed air via the connections 12, so that the lower edge of the fibre moulding becomes evenly compressed through the collar that bulges outwards. After relaxation of the pressure in the collar 9, the fibre moulding can be removed, through an increase in the pressure via the channels 3, from the moulding tool 2.

Figure 4:
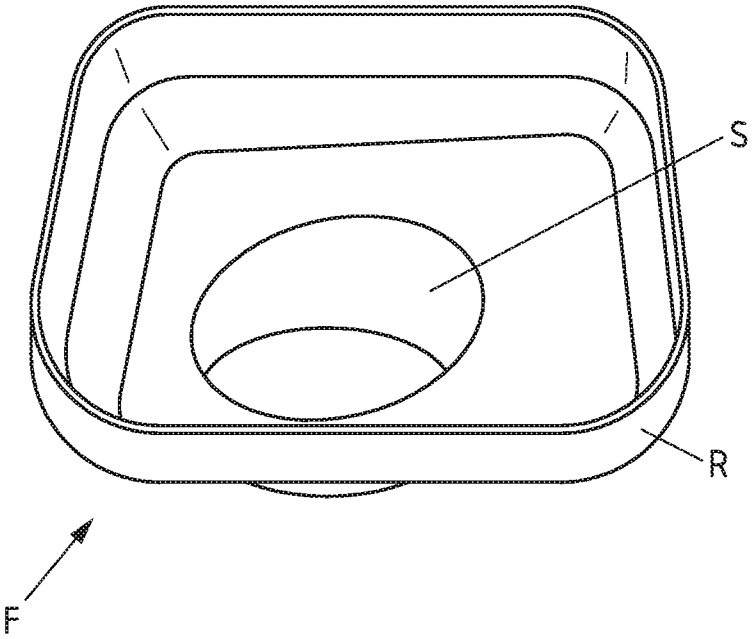

A fibre moulding F thus produced is shown in FIG. 4; for a better depiction of the contour according to forming wire 1 and/or moulding tool 2, the fibre moulding F is "upside down". One can clearly recognise a uniform circumferential edge R which is required for the sealing with a tube-shaped drinks container sleeve (not depicted). In addition, one can clearly discern a—in this illustration pointing downwards—connector S, which is suitable for accommodating a screw cap.

The invention claimed is:

1. A method for manufacturing a head or base element for drinks packaging containers formed from a fibre moulding, the method comprising the following steps:

dipping of a moulding screen arranged on a toolholder, said moulding screen extending along an outer contour of a moulding tool, into a fibre-containing pulp slurry in order to cover the moulding screen with fibre material, lifting of the toolholder in order to move the moulding screen covered with fibre material completely out of the pulp slurry, compressing the fibre material in an area of a peripheral edge of the moulding screen through expansion of a sleeve arranged around the moulding tool and going all the way around the moulding screen, relaxing pressure in the sleeve, removing fibre moulding from the moulding screen, transferring the fibre moulding onto a press tool, and mechanically compacting the fibre moulding on the press tool with a geometry corresponding to the fibre moulding.

2. The method according to claim 1, wherein an upper edge of the fibre moulding is sprayed with water before it is removed from the moulding screen.

3. The method according to claim 1, wherein the moulding screen is adapted to have air applied to it from an inside in such a way that both an underpressure, for precipitation of the fibre material, and an overpressure for releasing and removing the fibre moulding can be applied.

4. The method according to claim 1, wherein the fibre moulding is dried after removal.

5. The method according to claim 4, wherein the drying takes place using compressed air.

6. The method according to claim 4, wherein the drying takes place using thermal energy supplied.

7. The method according to claim 1, wherein an inner and an outer surface of the fibre moulding are coated so as to be gas-tight and/or liquid-tight.

8. The method according to claim 1, wherein an edge all the way around the fibre moulding is cut to length and an opening located in the fibre moulding is introduced.

9. The method according to claim 8, wherein the cutting to length of the edge or introduction of the opening take place by die-cutting or by laser cutting.

10. The method according to claim 1, wherein the toolholder with the moulding screen and the sleeve is cleaned by being sprayed with water.

* * * * *